United States Patent [19]

Ching-Tien

[11] 4,010,546

[45] Mar. 8, 1977

[54] ELLIPSE DRAWING INSTRUMENT

[76] Inventor: Pi Ching-Tien, No. 34, Lane 98, T'ung Hua St., Taipei, China /Taiwan

[22] Filed: Oct. 10, 1974

[21] Appl. No.: 505,439

[52] U.S. Cl. ..... 33/30 R; 33/30 C

[51] Int. Cl.[2] ..... B43L 11/04

[58] Field of Search ..... 33/30, 27 H

[56] References Cited

UNITED STATES PATENTS

| | | | |
|---|---|---|---|
| 817,645 | 4/1906 | Keel | 33/30 C |
| 1,626,430 | 4/1927 | Sanders | 33/30 R |
| 2,470,328 | 5/1949 | Towle | 33/30 F |
| 2,660,790 | 12/1953 | Polakowski | 33/30 F |
| 3,137,945 | 6/1964 | Da Silva | 33/30 C |
| 3,719,996 | 3/1973 | Filho | 33/30 C |

*Primary Examiner*—Richard E. Aegerter
*Assistant Examiner*—John W. Shepperd
*Attorney, Agent, or Firm*—Burns, Doane, Swecker & Mathis

[57] ABSTRACT

There is provided an ellipse drawing instrument the design of which is based upon the theory of orthogonal projection of a circle comprising a first leg having a pin point to be fixed on the surface to be drawn and a second leg having a drawing tip to be revolved around the first leg, the two legs being connected by a connecting member such as a pair of bars having parallel orientation and characterized as having the pin point end of the first leg extend upwardly as an axle and inserted into a sleeve. The top of said sleeve is rotatably mounted to an upper axle. The top of the upper axle, is pivoted with an inclinable axle which is inserted into a sleeve constituting a part of the L shaped connecting member of the second leg and functioning as a revolving arm. The top of the said sleeve is formed integrally with a turning wheel. The top of the inclinable axle is pivoted with a handle having a knob on it. The second leg comprising the free end of the connecting member is inserted into a rotatable short axle, the lower end of which is pivoted with the upper end of another short axle which is rotatably mounted on top of a long sleeve having a vertical slot on its upper part. Under the long sleeve is slidably inserted a writing implement holder having an angle adjustable member to retain a writing implement such as pencil lead or a drawing pen. A pair of leveling plates having a horizontal slot with one end fixed at the middle of the lower sleeve on the first leg and the other end fixed at the upper end of the writing implement holder are pivoted to be slidably also in the said horizontal slot of the leveling plate.

3 Claims, 7 Drawing Figures

ELLIPSE DRAWING INSTRUMENT

FIELD OF INVENTION

The present invention relates generally to an ellipse drawing instrument and more particularly to an instrument the design of which is based upon the theory that an orthogonal projection of an inclined circle would form an ellipse, and that the shape of the ellipse depends upon the degree of inclination. Hence the present invention comprises a two legged construction, with one leg disposed to remain fixed on the surface where the ellipse is to be drawn while the other leg, which is capable of being inclined with respect to the fixed leg, is disposed to follow a predetermined track wherein the angle of inclination is preset, i.e., the ratio between the major and minor axis of the desired ellipse is predetermined.

SUMMARY OF INVENTION

Therefore, the main object of the present invention is to provide a novel design of an ellipse drawing instrument which comprises two legs of the type resembling a common compass while the first of the two legs is so mechanically constructed that it is capable of being inclined with respect to the second one that is fixed to the drawing surface.

Another object of the present invention is to provide an ellipse drawing instrument that is capable of drawing an ellipse of desired shape by adjusting the inclination means.

Other objects and features will become apparent from the following detailed description to be taken on conjunction with the annexed drawings.

Figure 1:
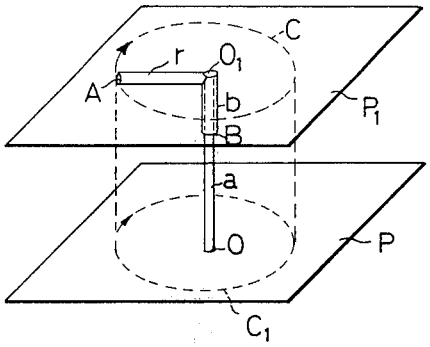
FIGS. 1 to 3 illustrate the theory that an orthogonal projection of an inclined circle would form an ellipse.
Figure 2:
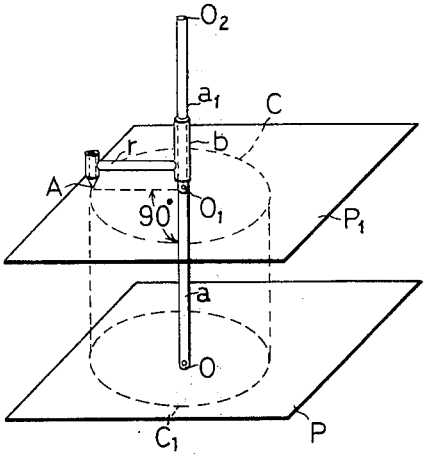
Figure 3:
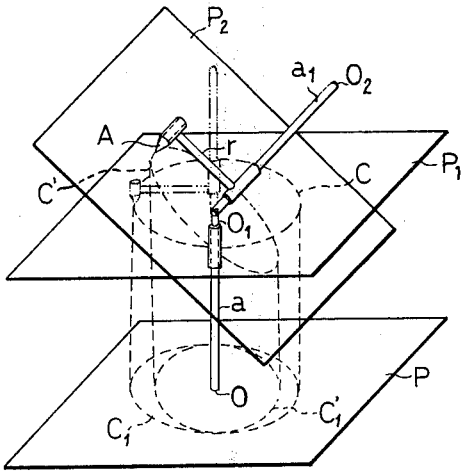
Figure 7:
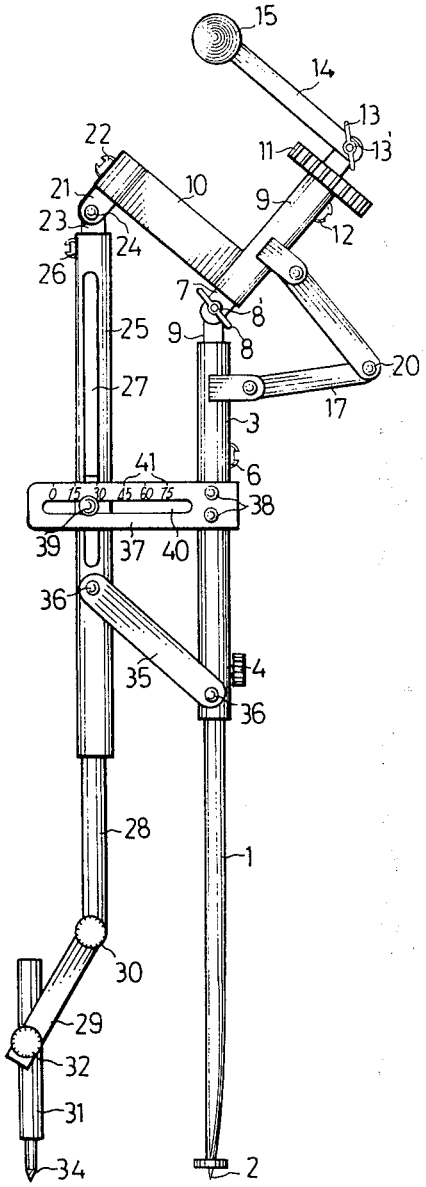
FIG. 7 is a front view in an inclined position.

DETAILED DESCRIPTION OF PREFERRED EMBODIMENT:

Now refer to FIGS. 1 to 3 for the theory which the present invention is based upon. In FIG. 1, a vertical axle $a$ of length $\mathbf{00_1}$ is perpendicular to horizontal planes P, $P_1$ which are disposed at the bottom and on the top of axle $a$ respectively. A sleeve $b$ with an arm $r$ having length $\mathbf{0_1}$A is rotatably mounted on top of axle $a$, when revolved around axle $a$, the end A of arm $r$ would give a track of circle C on plane $P_1$, and its orthogonal projection on plane P is also a circle $C_1$.

In FIG. 2, the axle $a$ is extended upwardly as $a_1$, to make the axle in two sections $\mathbf{00_1}$ and $\mathbf{0_1 0_2}$. Axles $a$ and $a_1$ are pivotally jointed at $\mathbf{0_1}$ to enable the section $a_1$ to be inclined to form any angle against the plane $P_1$. Yet when the two sections $a_1$ and $a$ are aligned and perpendicular to planes $P_1$ and P, the circle track C on plane $P_1$ would still have orthogonal projection on plane P as a circle $C_1$.

Then, as shown in FIG. 3, incline the axle section $a_1$ to a certain angle, on the plane $P_2$ vertical to axle $a_1$, the track made by point A by revolving arm $r$ around axle $a_1$ is a circle C′ while its projection on plane P is an ellipse $C_1'$. The shape of said ellipse $C_1'$ would be determined by the degree of inclination of axle $a_1$ (or plane $P_2$).

According to this theory, an ellipse drawing instrument can be designed. FIGS. 4 to 7 give a detailed structure of the said instrument.

Figure 6:
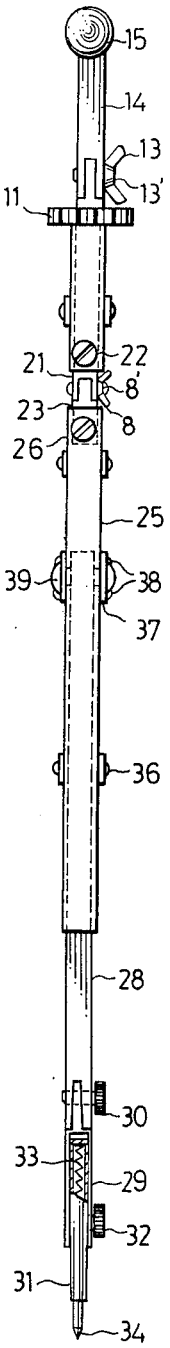
FIG. 6 is a left side view of the same embodiment.
Figure 4:
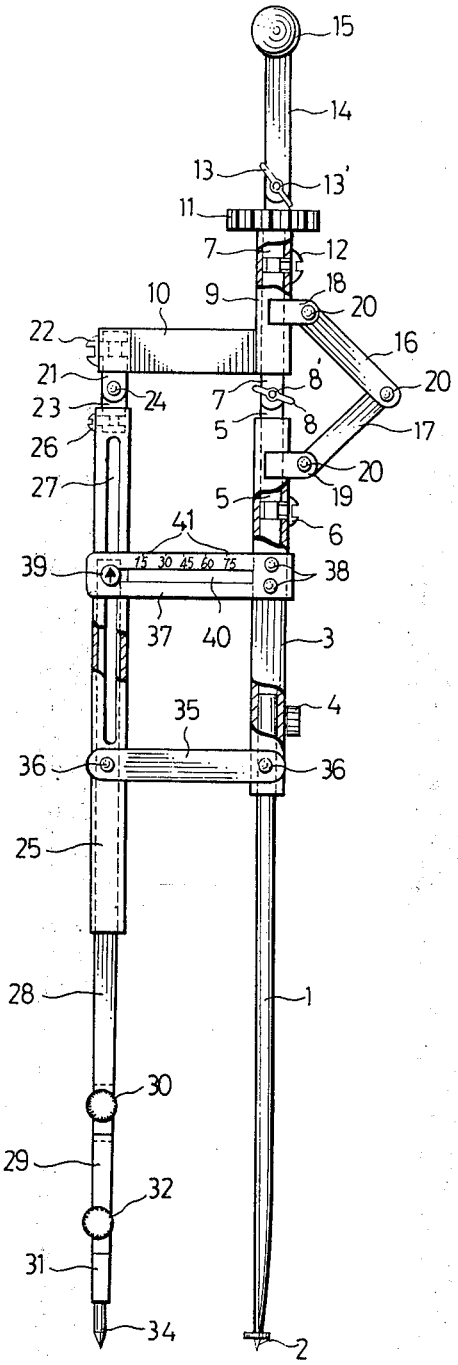
FIG. 4 is a front view of an embodiment of the present invention.
Figure 5:
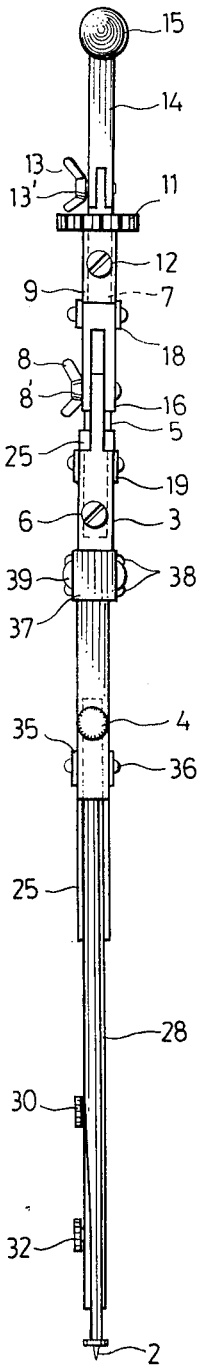
FIG. 5 is a right side view of the same embodiment.

In FIGS. 4, 5 and 6 the said instrument comprises two legs, the first leg having a pin point 2 is to be fixed on a drawing surface and the second leg, which is inclinable, having a pencil or pen 34 as drawing implement. The two legs are jointed pivotally at the middle by a pair of bars 35, by pins 36–36, and a connecting member 10 on top of the legs, so that the first leg-member 10 and the second leg-bars 35 form a parallelogram. The above-mentioned is a general picture of the instrument. A detailed description is followed hereunder.

In FIGS. 4 to 6, a vertical fixing axle 1 having pin point 2 at the lower end is slidably inserted in a sleeve 3 with a screw 4 to fix the position of axle 1. The top of sleeve 3 is rotatably mounted with a screw 6, to upper axle 5, the top of which is secured with wing bolt-nut set 8–8′, to an inclinable axle 7 which is inserted in a sleeve 9 which sleeve constitutes a part of the member 10 and is formed in L relationship with connecting member 10. On top of sleeve 9, a wheel 11 is formed integrally thereupon. A screw 12 is provided to retain the inclinable axle 7, and still have free rotation of axle 7 within sleeve 9. A handle 14 with knob 15 on it, is pivotally mounted on top of axle 7 by bolt-nut set 13–13′. Elbow-like flexible member 16–17 is jointed with pivot pins 20 on rotary ear 18 on sleeve 9 and rotary ear 19 on sleeve 3. This member 16–17 serves to connect sleeves 3 and 9 to make them rotate in a synchronous fashion. The above-mentioned description relates primarily to the first leg.

Referring to the second leg, a short axle 21 is rotatably mounted by a screw 22 to the free end of connecting member 10.

The lower end of axle 21 is connected to another short axle 23 by a pivot pin 24. The lower end of axle 23 is rotatably mounted by a screw 26 to the upper end of a long sleeve 25 having a long slot formed along the upper portion. Inserted into the lower end of sleeve 25 is a writing implement holder 28, the lower end of which, is pivotally mounted to an angle adjusting member 29 by a screw 30. The adjusting member 29 is further pivotally connected to a lead retainer 31 by a screw 32. Lead 34 is inserted into the lower end of the lead retainer 31 wherein a spring means 33 is provided. Of course the lead retainer 31 may also be substituted by any writing implement like a drawing pen, etc. The above is a description of the second leg.

In addition to the connecting member 10, a pair of bars 35–35, connect the middle of the two legs by pivot pins 36–36. A pair of leveling plates 37–37 each have one end fixed on sleeve 3 of the first leg by pins 38–38 and the other end fixed on the upper end of sleeve 28 by pin 39 which pin is slidable within the vertical slot 27 of sleeve 25 of the second leg. The slidable pin 39 also falls within a horizontal slot provided on leveling plate 37–37. Along the horizontal slot 40, degrees of angle of inclination are calibrated on scale 41.

In using the said instrument as a common compass to draw a circle, first align axles 5 and 7, fix pin point 2 of the first leg on the surface to be drawn, hold handle 14 in a vertical position with one hand and turn wheel 11 with another hand. The second leg is rotated around the first leg. The track made by the pencil 34 is a circle.

The radius of the circle drawn is decided by the distance between pin point 2 and the pencil tip 34. This can be easily achieved by adjusting the length of axle 1 and the angle of adjusting member 29 to obtain what is desired.

When an ellipse is desired to be drawn with the present instrument, adjust the instrument to a position as shown in FIG. 4, by fixing the pin point 2 at the center of the ellipse to be drawn, and adjusting the distance between the pencil tip 34 and pin point 2 to equal the major axis of the ellipse. Then, as in FIG. 7, release wing nut 8, incline sleeve 9 to an angle until the distance between tip 34 and pin point 2 is to equal the minor axis of the desired ellipse, and lock the nut 8. Revolving the second leg around the fixed first leg, the sleeve 28 slides up-down in the slot 27, and the curve drawn is an ellipse as desired. for easier operation, the knob 15 of handle 14 may be bent down to a position right on top of the aligned axles 5 and 7. Thus one can hold the knob 15 with one hand and turn wheel 11 to rotate the instrument.

In another application, when an orthogonal projection of an inclined circle of known radius is to be drawn, set the distance between tip 34 and pin point 2 to equal the known radius, then set the degree of inclination as indicated on the calibrated scale 41, lock the nut 8, and the drawing will show an ellipse as desired.

I claim:

1. An ellipse drawing compass comprising:

a first axle with a point adapted to contact a drawing surface, a first sleeve slidably mounted about said first axle, means to releasably secure said first axle to said first sleeve, a second axle rotatably mounted in said first sleeve about said first axle, a third axle with means to adjustably mount same to said second axle at an incline, a second sleeve rotatably mounted about said third axle, means connecting said first sleeve to said second sleeve to synchronize the rotation of said sleeves about said axles comprising two arms pivotally connected to said sleeves and to each other, a drawing leg comprising an implement holder slidably mounted in a third sleeve, said third sleeve having a longitudinal slot and said holder having a pin which slides in said slot, a first connecting member with means pivotably connecting same to said first sleeve and said third sleeve, a second connecting member with first means rigidly connecting same to said first sleeve and further having a longitudinal slot normally disposed in the horizontal plane said slot further receiving said pin for sliding movement, and a third connecting member with first means to rigidly connect same to said second sleeve and second means to pivotally connect same to said third sleeve.

2. Ellipse drawing instrument according to claim 1 wherein along the horizontal slot of the leveling plate scales are calibrated to indicate the degree of inclination between the related legs.

3. Ellipse drawing instrument according to claim 1, an elbow like flexible member is provided to joint the two sleeves on first leg to synchronize the rotation of the two sleeves.

* * * * *